US011006723B2

(12) United States Patent
Kim

(10) Patent No.: US 11,006,723 B2
(45) Date of Patent: May 18, 2021

(54) PUSH TYPE COSMETIC CONTAINER

(71) Applicants: CTK CO., LTD, Seongnam-si (KR); Jin Woo Kim, Anyang-si (KR)

(72) Inventor: Jin Woo Kim, Anyang-si (KR)

(73) Assignee: CTK CO. LTD., Seongnam-si (KR)

( * ) Notice: Subject to any disclaimer, the term of this patent is extended or adjusted under 35 U.S.C. 154(b) by 422 days.

(21) Appl. No.: 16/068,481

(22) PCT Filed: Feb. 14, 2017

(86) PCT No.: PCT/KR2017/001577
§ 371 (c)(1),
(2) Date: Jul. 6, 2018

(87) PCT Pub. No.: WO2017/146408
PCT Pub. Date: Aug. 31, 2017

(65) Prior Publication Data

US 2019/0014881 A1 Jan. 17, 2019

(30) Foreign Application Priority Data

Feb. 22, 2016 (KR) ..... 10-2016-0020777
Mar. 30, 2016 (KR) ..... 10-2016-0038161

(51) Int. Cl.
*A45D 34/00* (2006.01)
*A45D 40/00* (2006.01)
(Continued)

(52) U.S. Cl.
CPC ..... *A45D 34/00* (2013.01); *A45D 33/006* (2013.01); *A45D 34/04* (2013.01); *A45D 34/041* (2013.01);
(Continued)

(58) Field of Classification Search
CPC ..... A45D 33/02; A45D 33/04; A45D 33/06; A45D 33/006; A45D 33/003;
(Continued)

(56) References Cited

U.S. PATENT DOCUMENTS

2012/0125361 A1* 5/2012 Yeom ..... A45D 33/26 132/293
2016/0227903 A1* 8/2016 Kang ..... A45D 40/22
2017/0280852 A1* 10/2017 Kang ..... A45D 40/222

FOREIGN PATENT DOCUMENTS

KR 20-0470757 Y1 1/2014
KR 10-1449663 B1 10/2014
(Continued)

*Primary Examiner* — Rachel R Steitz
*Assistant Examiner* — Karim Asqiriba
(74) *Attorney, Agent, or Firm* — John K. Park; Park Law Firm

(57) ABSTRACT

The present invention provides a push type cosmetic container that includes: an inner container (30) having a vertical tube (32) formed at the center of a storage space (31) for keeping makeup to feed the makeup vertically upward; a shoulder (40) fixed on the top of the inner container; a piston (50) inserted in the storage space (31) to be movable downward; and a valve unit (60) for discharging the makeup by opening a valve body (61) coupled to the top of the vertical tube (32) in the inner container when the piston (50) is pressed by pressing a pressing plate (63) elastically supported over the inner container (30) by a spring (65).

17 Claims, 16 Drawing Sheets

(51) Int. Cl.
*A45D 40/26* (2006.01)
*A45D 34/04* (2006.01)
*A45D 33/00* (2006.01)

(52) U.S. Cl.
CPC ..... *A45D 40/00* (2013.01); *A45D 40/261* (2013.01); *A45D 2200/055* (2013.01); *A45D 2200/1018* (2013.01)

(58) Field of Classification Search
CPC ..... A45D 33/025; A45D 40/0075; A45D 2200/055; A45D 2200/054; A45D 2200/051; A45D 34/00
USPC ..... 132/298, 299, 293; 206/581; 220/260, 220/281, 315, 324, 326
See application file for complete search history.

(56) References Cited

FOREIGN PATENT DOCUMENTS

| | | | |
|---|---|---|---|
| KR | 20-2014-0005943 | U | 11/2014 |
| KR | 10-2016-0005242 | A | 1/2016 |
| KR | 10-1663927 | B1 | 10/2016 |

* cited by examiner

PUSH TYPE COSMETIC CONTAINER

The present invention relates to a push type cosmetic container. More particularly, it relates to a push type cosmetic container using a simple structure that elastically presses a pressing plate with a spring instead of an airless pump to protrude makeup.

In general, a cosmetic container is used to keep makeup.

In particular, gel types of makeup are used to prevent effusion of the makeup and increase skin absorption and cosmetic containers having an airless pump structure have been generally used to keep the gel types of makeup.

The cosmetic containers having an airless pump structure are composed of an outer container composed of a top body and a bottom body and an inner container disposed inside the outer container to keep makeup, in which a piston and an airless pump, a lever operation unit for pushing the airless pump, and a makeup dish for putting makeup discharged from the airless pump on a puff in use are disposed over the inner container, so when the airless pump is pressed by the lever operation unit, the piston is moved downward by external air flowing inside so that the makeup is discharged sequentially to the inner container, the airless pump, and the makeup dish.

As described above, the cosmetic containers of the related art have a complicated structure assembled by sequentially combining several parts such as an airless pump and a lever operation unit to discharge makeup, so efficiency of assembling and manufacturing the containers is low and the manufacturing cost is high.

In particular, it is required to assemble several parts even after filling the inner container with makeup and the makeup may be poured out of the containers due to carelessness of the worker in the process of assembling the containers, so there are various problems including inconvenience in assembly.

Obviously, a way of assembling parts for discharging makeup and then filling a container with makeup in a backfilling type has been used in the related art in consideration of the problems, but in this case, there is a serious problem that insufficient filling of about 30% is caused by a structural problem due to backfilling of makeup.

Further, a structure for hermetically keeping makeup is not secured, so the makeup may leak when the cosmetic containers are carried. In particular, due to various problems such as the problem that the makeup remaining in the path for discharging a makeup dish not only is contaminated, but leaks to the outside thereby contaminating the container, plans for overcoming these problems is required.

RELATED DOCUMENTS (Patent Document 1) KR 2020140005943 U (published on 26 Nov. 2014)

(Patent Document 2) KR 1020130040679 A (published on 24 Apr. 2013)

BACKGROUND OF INVENTION

The present invention has been made in an effort to solve these problems and an object of the present invention is to discharge makeup for use by pressing a piston using a simple structure that elastically presses a pressing plate with a spring instead of an airless pump.

Another object to of the present invention is to assemble a cosmetic container at one time after filling an inner container with makeup, with a valve unit, a shoulder, and a piston assembled over the inner container.

Another object of the present invention is to prevent remaining makeup from leaking outside by preventing a pressing plate from moving downward before it is pressed first, and by improving a structure for sealing a path for discharging makeup.

A push type cosmetic container according to an aspect of the present invention includes: an inner container inserted in a bottom body of an outer container and having a vertical tube formed at a center of a storage space for keeping makeup to feed the makeup vertically upward; a shoulder fixed on the inner container; a piston inserted in the storage space of the inner container to be movable downward, and a valve unit for discharging the makeup by opening a valve body coupled to a top of the vertical tube in the inner container when the piston is pressed by pressing a pressing plate elastically supported over the inner container by a spring, in which the valve unit includes: the valve body fitted on the vertical tube of the inner container and having a valve hole and discharge holes circumferentially arranged at an upper portion; a pressing plate disposed outside the upper portion of the valve body and having pressing bars on a bottom for pressing the piston; and the spring elastically supporting the bottom of the pressing plate, in which an inner side of the pressing plate is elastically in close contact with an inclined surface formed on an outer side of the upper portion of the valve body to open and close the discharge holes of the valve body when the pressing plate is pressed.

A packing being in elastically close contact with the inclined surface on the outer side of the upper portion of the valve body may be disposed inside the pressure plate for hermetic operation.

An upper outer side of the pressing plate may be spaced from a locking step formed on an inner side of an upper portion of the shoulder so that the pressing plate is in close contact with the inclined surface on the outer side of the upper portion of the valve body by elasticity of the spring.

Air vents may be formed at one or more positions on an inner side of the storage space of the inner container from an upper end to an initial insertion position of the piston.

A recession that is lower than a top of the pressing plate may be formed on a top of the valve body.

Coupling projections each having a locking step on an upper outer side may be vertically formed on the piston and, coupling holes in which the coupling projections are inserted may be formed in the shoulder and a locking step locking the locking steps of the coupling projections to prevent separation may be formed on an inner side of the shoulder so that an assembly of the valve unit, the shoulder, and the piston is combined with the bottom body of the outer container, and the locking steps of the piston and the locking step of the shoulder may be rounded projections to release the pressing plate when the pressing plate is initially pressed.

The spring elastically supporting the pressing plate may have any one of a conical shape and an inverse conical shape.

The pressing bars on the bottom of the pressing plate may be spaced at a predetermined distance from a top of the piston.

The shoulder, the piston, and the valve unit may be combined in one assembly and then the assembly may be combined with the bottom body and the inner container filled with makeup.

A remaining pressure remover for removing remaining pressure generated when the piston is combined may be further provided in the storage space of the inner container.

The remaining pressure remover may include: a support vertically supported in the inner container and a cap made of elastic rubber and having a first part integrally coupled to the support and a second part having pressure removable holes for discharging internal pressure of the inner container to the outside when the piston is combined, and a coupling hole fitted on the second end of the cap may be formed through the piston and the pressure removable holes at the second part may be closed by elastic contact with a covering portion formed on the shoulder at a corresponding position when the piston finishes being combined.

According to the present invention, the makeup is simply discharged by pressing the piston through a simple structure elastically supporting the pressing plate with the spring instead of an airless pump, so productivity is improved, the manufacturing cost is reduced, and convenience in use is provided for users.

Further, since the valve unit, the shoulder, and the piston to be coupled to the top of the inner container are combined in one assembly and then the assembly is combined with the inner container filled with makeup at one time, assembly is simple.

Further, the piston is prevented from moving downward before the pressing plate is initially pressed for use and the remaining of the makeup is prevented from being discharged outside by improving a hermetic structure for the path for discharging the makeup, so it is possible to prevent contamination of the makeup and the container.

Further, the remaining pressure that is not discharged through the air vent when the piston is inserted in the inner container filled with makeup is secondarily discharged through the remaining pressure remover, so the piston can be more quickly and stably combined.

BRIEF DESCRIPTION OF DRAWINGS

FIG. 1A is the same perspective view as FIG. 1, showing the cutaway line 12-12 as shown in FIG. 12 and cutaway sectional view line 11B-11B as shown in FIG. 11B.

Figure 1:
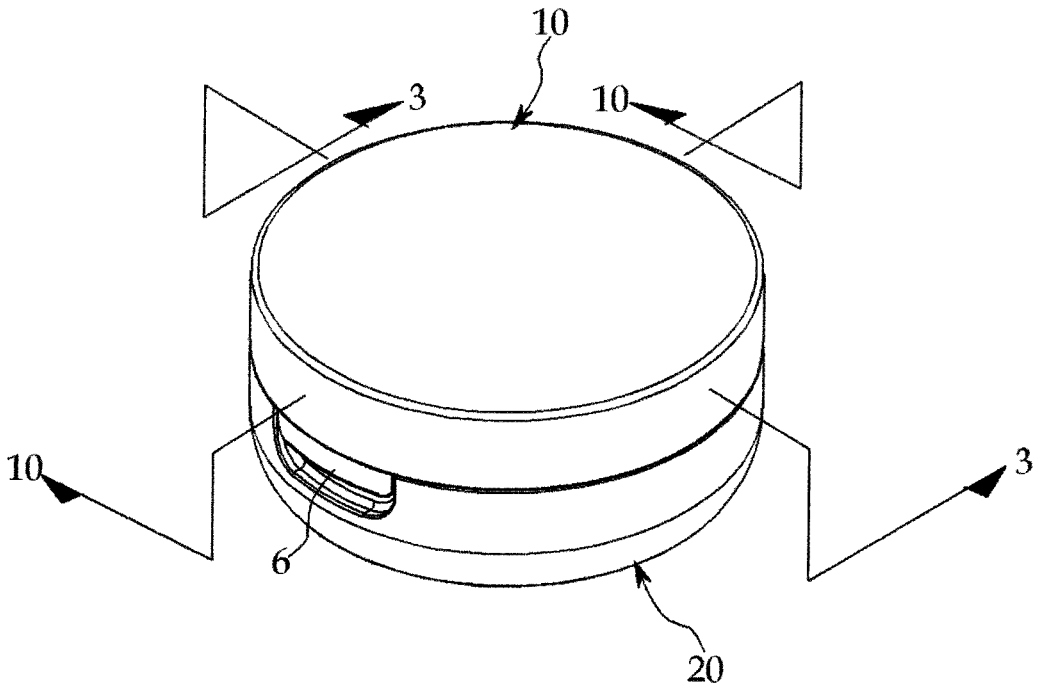
FIG. 1 is a perspective view showing the external appearance of a cosmetic container of the present invention.
Figure 2A:
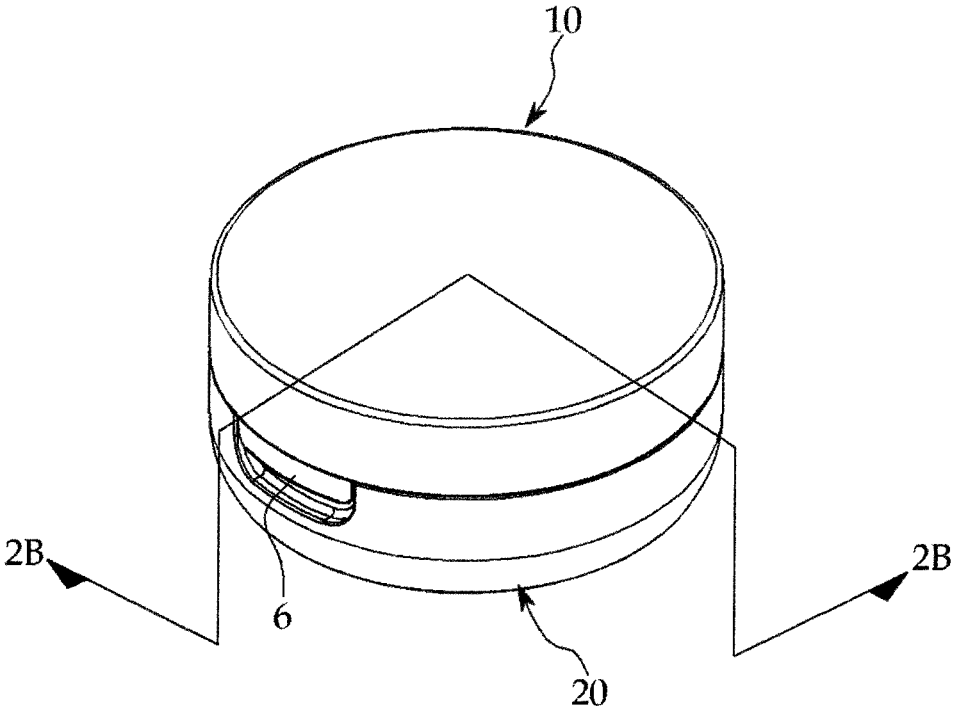
FIG. 2A is the same perspective view as FIG. 1 showing the cutaway view line 2B-2B as shown in FIG. 2B
Figure 2B:
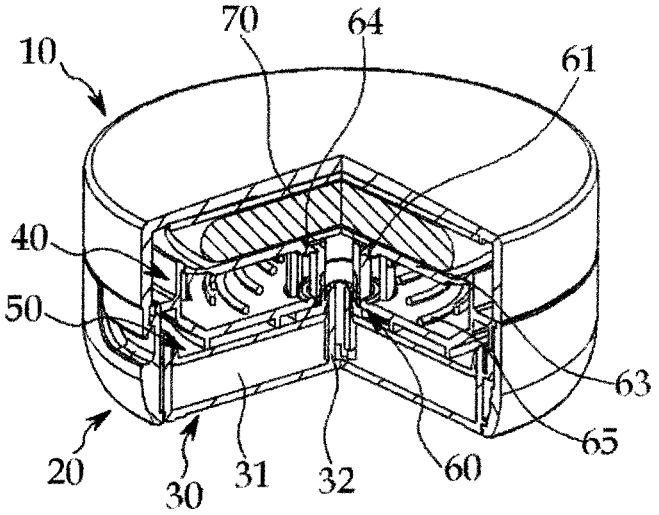
FIG. 2B is a partial cutaway perspective view as marked by line 2B-2B in FIG. 2A.
Figure 3:
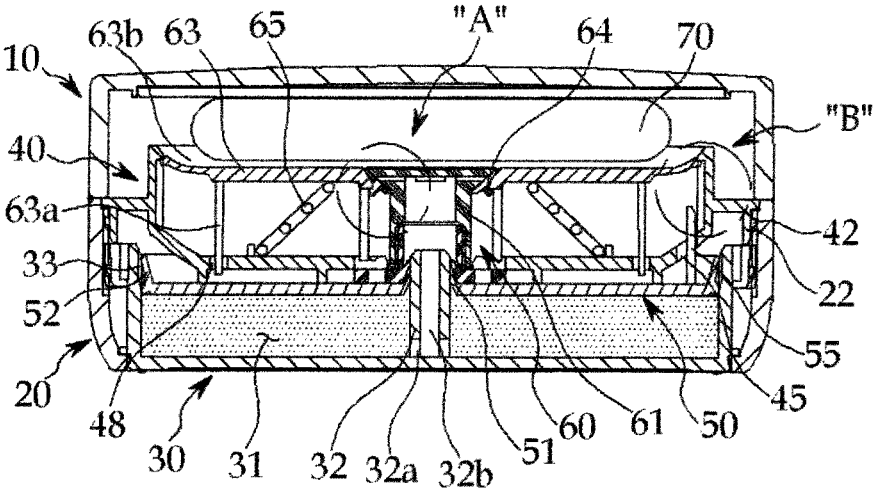
FIG. 3 is a front cross-sectional view showing the cosmetic container of the present invention.
Figure 4:
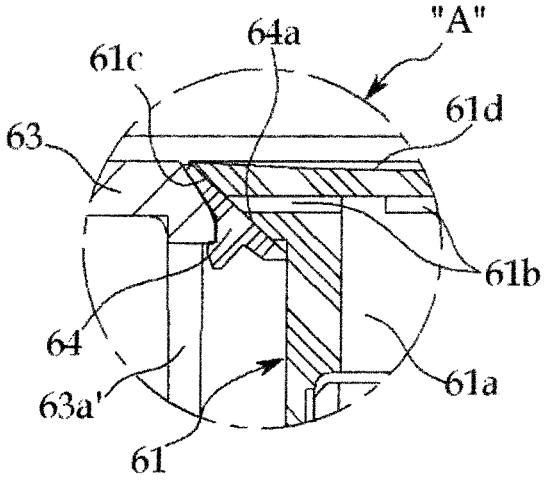
FIG. 4 is a partial enlarged view of the portion A of FIG. 3.
Figure 5:
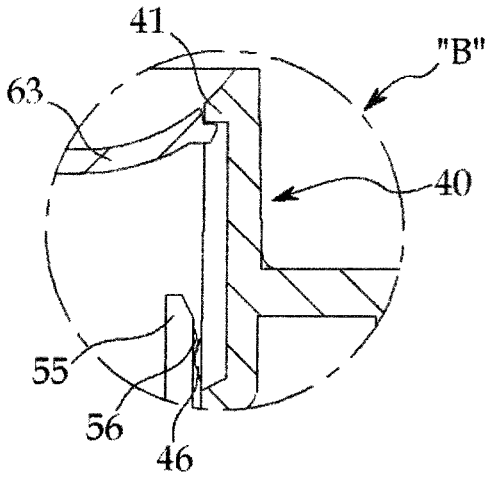
FIG. 5 is a partial enlarged view of the portion B of FIG. 3.

| LIST OF REFERENCE NUMBERS USED ON THE DRAWING | |
|---|---|
| 10: Top body | 20: Bottom body |
| 30: Inner container | 31: Storage space |
| 32: Vertical tube | 33: Air vent |
| 40: Shoulder | 41: Step |
| 46: Locking step | 50: Piston |
| 55: Coupling projection | 56: Locking step |
| 60: Valve unit | 61: Valve body |
| 61a: Valve hole | 61b: Discharge hole |
| 61c: Inclined surface | 61d: Recession |
| 63: Pressing plate | 63a: Pressing bar |
| 64: Packing | 65: Spring |
| 80: Remaining pressure remover | |
| 81: Support | 82: Cap |
| 82a: Pressure removable hole | |
| 83: Coupling hole | 84: Covering portion |

DESCRIPTION OF INVENTION

Hereinafter, exemplary embodiments of the present invention will be described in detail with reference to the accompanying drawings.

A push type cosmetic container of the present invention, as shown in FIGS. 1 to 9, includes a top body 10, a bottom body 20, an inner container 30, a shoulder 40, a piston 50, and a valve unit 60.

The top body 10 and the bottom body 20, which form an outer container, are hinged at a side to each other to open/close up/down and are locked or unlocked by a locking portion 6 at another side.

The inner container 30 is inserted in the bottom body 20 of the outer container and has a storage space 31 for keeping makeup therein and a vertical tube 32 formed at the center of the storage space 31 and having a feeding hole 32*b* for vertically feeding up makeup flowing into a hole 32*a* under the feeding hole.

The shoulder 40 is inserted in the upper portion of the inner container in the bottom body 20 such that a coupling projection 42 on the side is inserted and fixed in a coupling groove 22 on the side of the bottom body 20.

The piston 50 is inserted in the storage space 31 of the inner container 30, has an inner wing 51 at the inner edge to be able to move downward in elastically close contact with the outer side of the vertical tube 32*a* and an outer wing 52 extending outward at the outer edge to be able to move downward in elastically close contact with the inner side of the storage space 31 of the inner container 30.

Air vents 33 are formed at one or more positions on the inner side of the storage space 31 of the inner container 30 from the upper end to the initial insertion position of the piston 50 to remove vacuum pressure when the piston 50 is initially inserted.

The valve unit 60, which is a part for discharging makeup when the piston 50 is pressed, includes: a valve body 61 that is fitted on the vertical tube 32 of the inner container and has a valve hole 61*a* and discharge holes 61*b* circumferentially arranged at the upper portion; a pressing plate 63 that is disposed outside the upper portion of the valve body 61 and has pressing bars 63*a* on the bottom for pressing the piston 50; and a spring 65 that elastically supports the bottom of the pressing plate 63. The inner side of the pressing plate 63 is elastically in close contact with an inclined surface 61*c* formed on the outer side of the upper portion of the valve body 61 to open/close the discharge holes 61*b* of the valve body when the pressing plate 63 is pressed.

A packing 64 having an inclined surface 64*a* on the inner side is disposed in the pressing plate 63 to be elastically and hermetically in close contact with the inclined surface 61*c* on the outer side of the upper portion of the valve body 61.

Further, the pressing plate 63 has a puff seat 63*b* on the top for keeping a puff 70 and the upper outer side of the pressing plate is not in contact with, but spaced about 0.5~1 mm from a step 41 on the upper inner side of the shoulder 40 so that the pressing plate 63 is in contact as close as possible with the inclined surface 61*c* on the upper outer side of the valve body 61 by elasticity of the spring 65 to increase elasticity.

Further, the pressing bars 63*a* on the bottom of the pressing plate 63 are also spaced about 0.8~1 mm from the top of the piston 50 to prevent an error when the piston is unexpectedly pressed.

Further, a recession 61*d* lower than the top of the pressing plate is formed on the top of the valve body 61 to make sure that the pressing plate 63 is pressed by the recession when a user presses both of the pressing plate 63 and the valve body 61.

Further, the valve body 61 is divided into an upper body 61-1 and a lower body 61-2 that are thread-fastened to each other.

Figure 6:
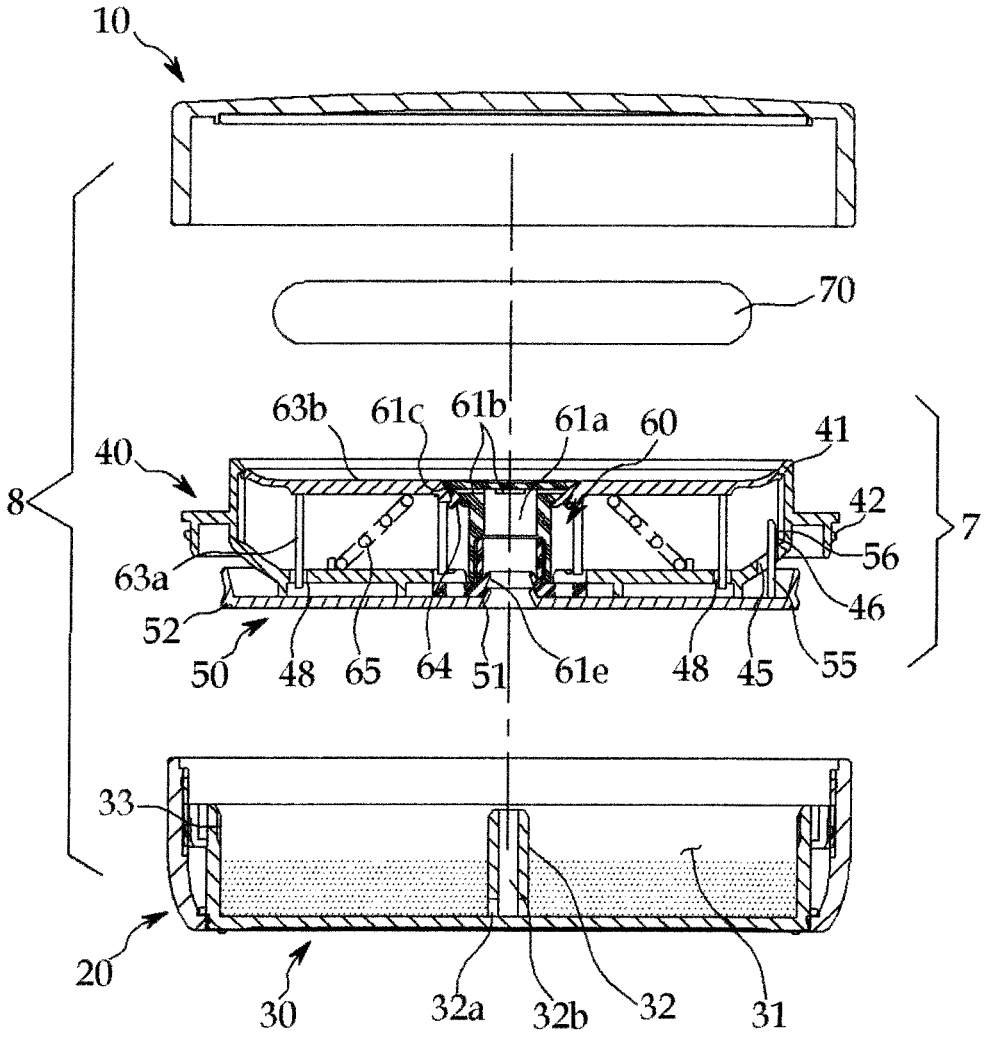
FIG. 6 is an exploded perspective view before the cosmetic container shown in FIG. 3 is assembled.
Figure 7:
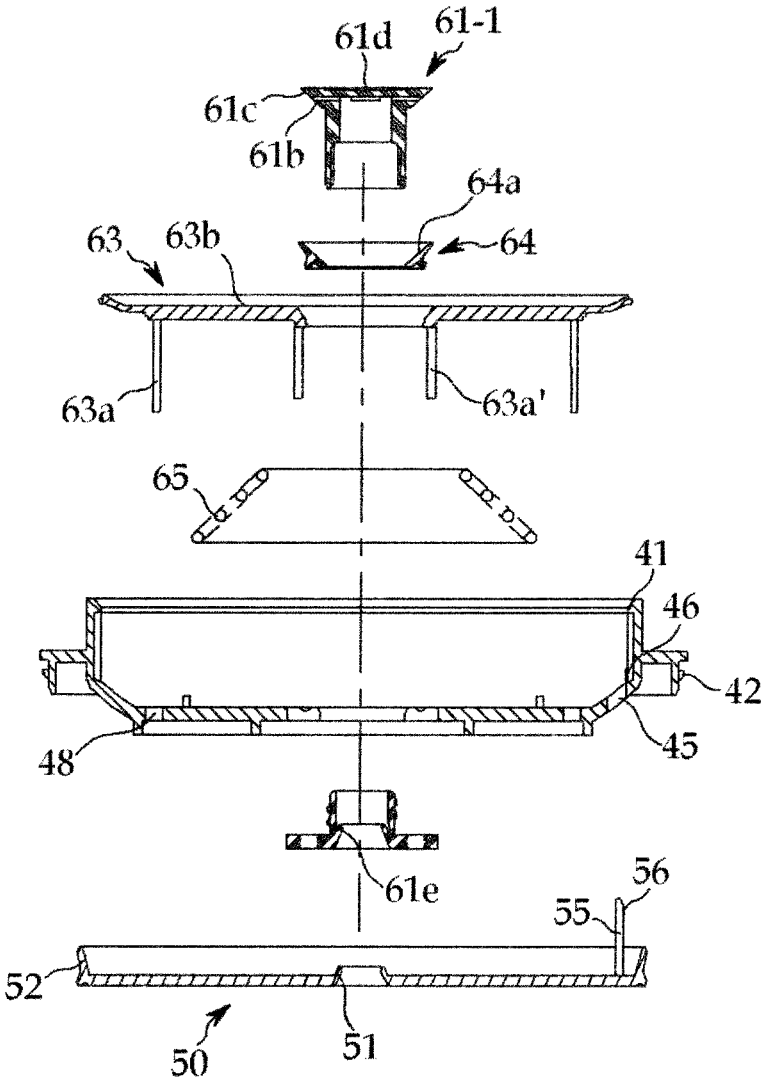
FIG. 7 is an enlarged cross-sectional view showing a part of FIG. 6, marked by a bracket "7".
Figure 8:
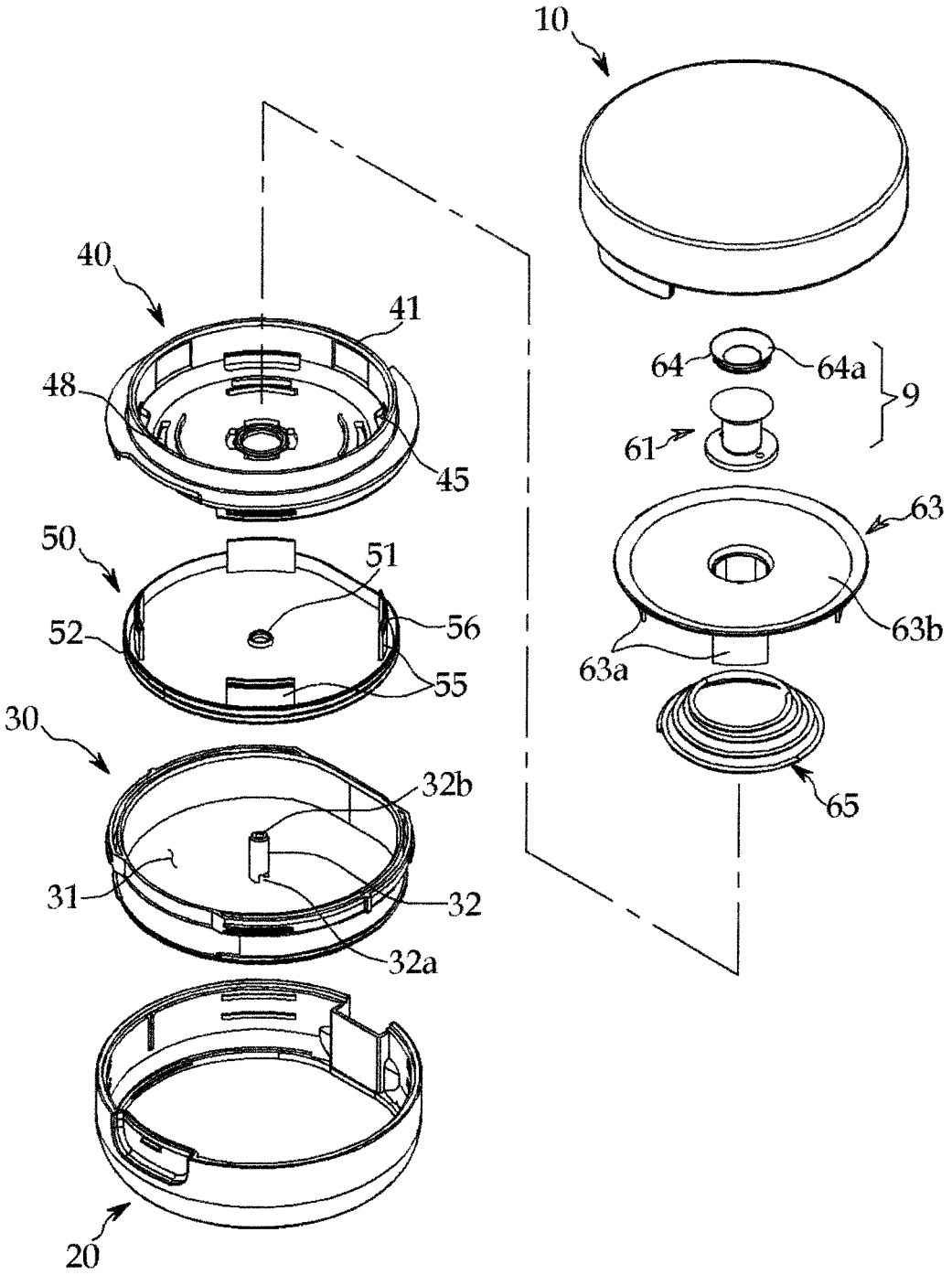
FIG. 8 is an exploded perspective view showing the section marked by a bracket "8" as shown in FIG. 6.
Figure 9:
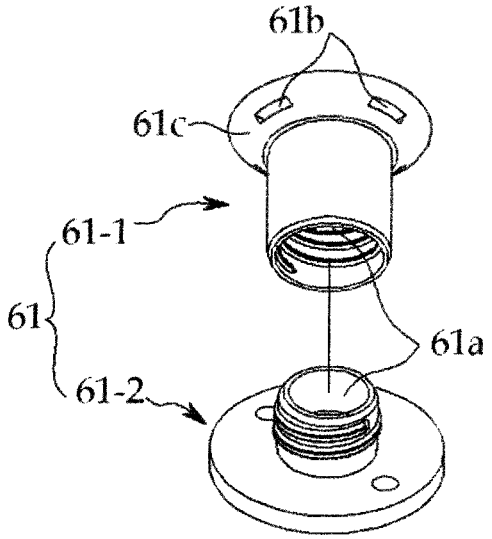
FIG. 9 is an exploded perspective view showing a valve body, marked by a bracket "9" as shown in FIG. 8.
Figure 10:
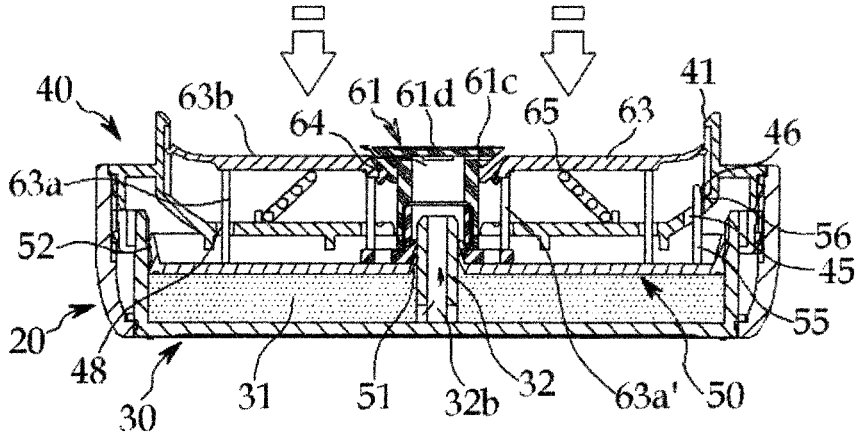
FIG. 10 is a cross-sectional view showing the operation of the present invention.
Figure 11A:
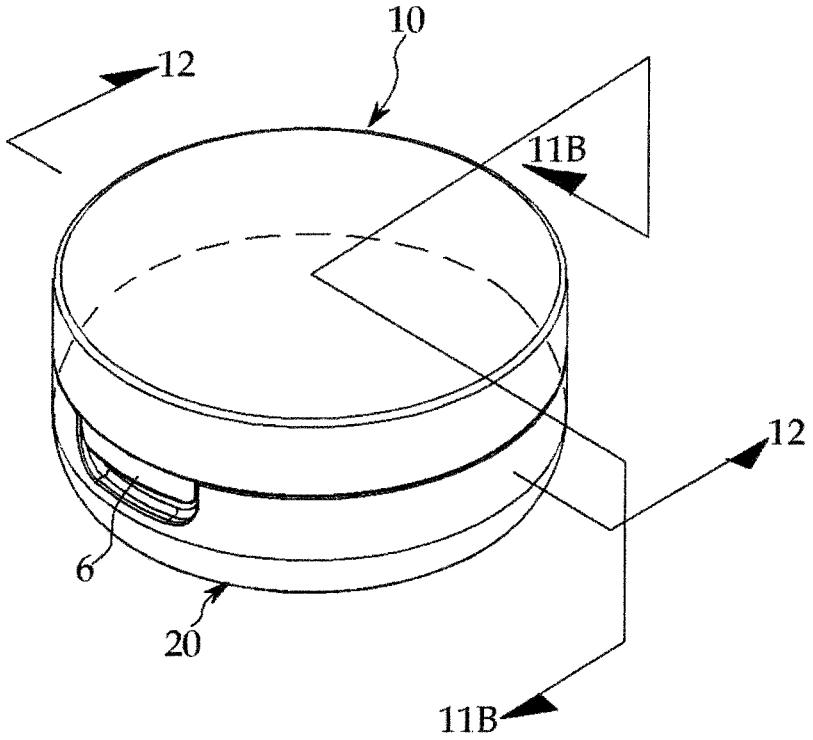
FIG. 11B is a partial cutaway perspective view as marked by line 11B-11B in FIG. 11A.
Figure 11B:
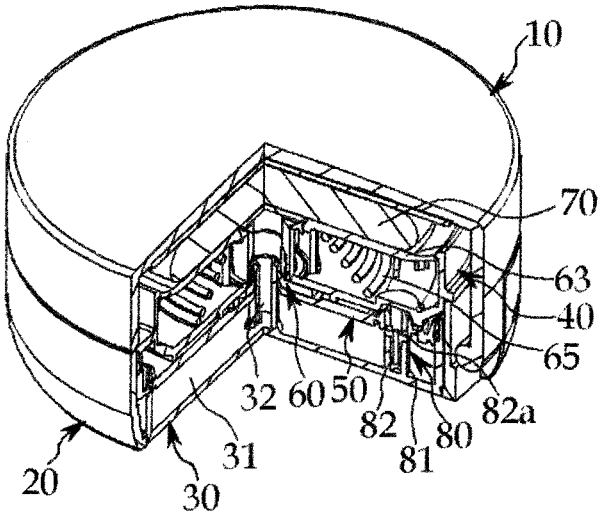
Figure 12:
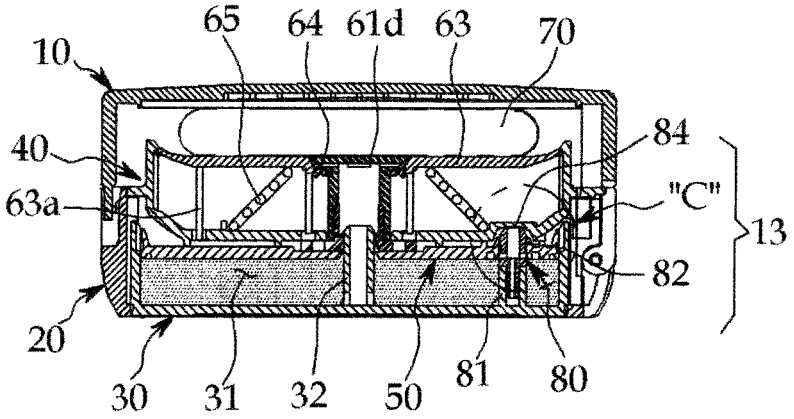
FIG. 12 is cross-sectional view of the assembly marked by cutaway view line 12-12 as shown in FIG. 11.
Figure 13:
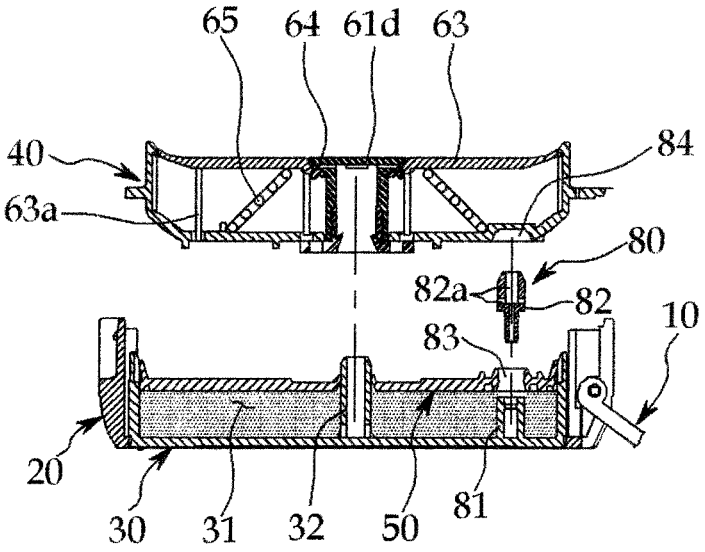
FIG. 13 is an exploded cross-sectional view showing the section shown by a bracket marked 13" in FIG. 12.
Figure 14:
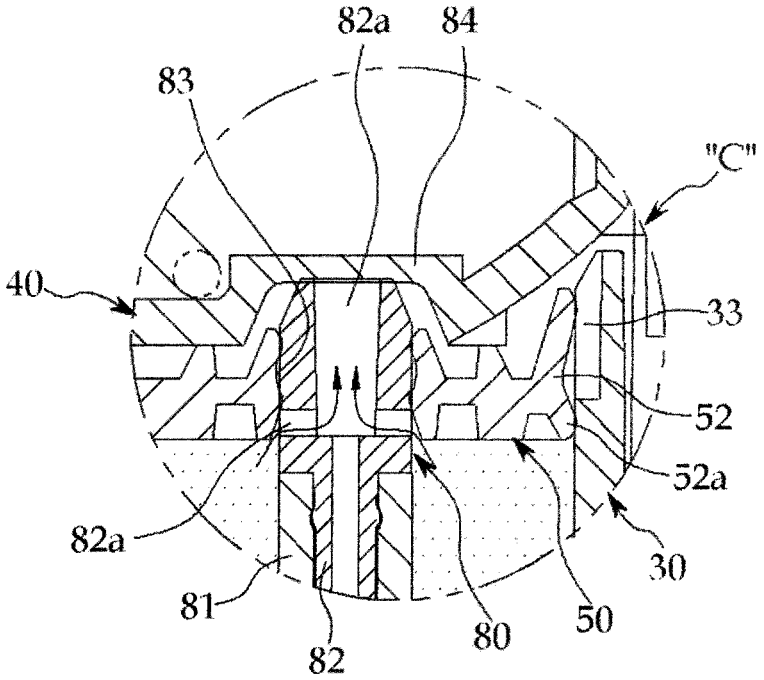
FIG. 14 is a partial enlarged view of the portion C of FIG. 12.

Further, the present invention provides an assembly structure obtained by assembling first the valve unit 60, the shoulder 40, and the piston 50, as shown in FIG. 6, and then combining the assembly at one time with the inner container 30 filled with makeup and the bottom body 20.

That is, coupling projections 55 each having a locking step 56 on the upper outer side are vertically formed on the piston 50 and, coupling holes 45 in which the coupling projections 55 are inserted are formed in the shoulder 40 and a locking step 46 locking the locking steps 56 of the coupling projections is formed on the inner side of the shoulder 40 so that the assembly of the valve unit 60, the shoulder 40, and the piston is combined with the bottom body 20 of the outer container.

The locking steps 56 of the piston 50 and the locking step 46 of the shoulder 40 are rounded projections to release the pressing plate 63 when the pressing plate 63 is initially pressed.

Further, according to the present invention, the spring 65 elastically supporting the pressing plate 63 with respect to the shoulder 40 may be formed in a conical shape to ensure minimum height and space and a maximum downward movement distance of the pressing plate 63. The spring 65 may be disposed in the shape of an inverse cone.

Reference numeral '48' indicates holes formed through the bottom of the shoulder 40 to receive the pressing bars of the pressing plate, reference numeral '61*e*' indicates a sealing projection that protrudes inside the lower portion of the valve and is in contact with the outer side of the vertical tube 32 of the inner container, and reference numeral '63*a*' indicates sub-pressing bars that protrude shorter than the pressing bars 63*a* from the bottom of the pressing plate to prevent the pressing plate 63 and the valve body 61 from excessively opening while moving downward together after the pressing plate 63 presses packing and then the valve body 61.

Operation of the present invention having this configuration is described hereafter.

First, in a process of the cosmetic container of the present invention, the shoulder 40, piston 50, and valve unit 60 are assembled.

That is, as shown in FIG. 6, the pressing plate 63 is put on the shoulder 40 with the spring 65.

In this state, the pressing bars 63*a* on the bottom of the pressing plate 63 are inserted in the holes 48 formed through the bottom of the shoulder 40.

In this state, the upper body 61-1 of the valve body 61 is inserted from above into the center of the pressing plate 63 and the lower body 61-2 is inserted from under into the shoulder 40, and then they are thread-fastened to each other.

The shoulder 40 and the valve unit 60 are combined in this way.

The piston 50 is coupled to the lower portion of the shoulder 40 such that the coupling protrusions 55 on the piston are inserted in the coupling holes 45 formed through the bottom of the shoulder, with the locking steps 56 on the outer side of the coupling projections locked to the locking step 46 on the inner side of the shoulder to prevent separation.

Accordingly, the shoulder 40, the valve unit 60, and the piston 50 are combined in one assembly.

The storage space 31 of the inner container 30 is filled with makeup first and then the assembly of the shoulder 40, the valve unit 60, and the piston 50 are combined with the inner container at one time.

That is, the piston 50 is inserted into the storage space 31 of the inner container, the valve body 61 is inserted into the vertical tube 32 of the inner container, and the coupling projection 42 of the shoulder 40 is inserted into the coupling groove 22 on the side of the bottom body, thereby fixing the assembly.

The piston 50 is hermetically inserted in the vertical tube 51 at the center of the inner container and the outer wing 52 is hermetically inserted in the storage space 31 of the inner container.

In particular, since the air vent 33 is formed at the upper portion in the storage space 31 of the inner container 30, air is discharged and vacuum is removed while the outer wing 52 of the piston 50 is inserted, so the piston is smoothly inserted.

As described above, according to the present invention, the inner container 30 is filled with makeup, with the shoulder 40, valve unit 60, and piston 50 combined in one assembly, and then they are combined at one time.

In the assembly, the piston 50 is prevented from moving downward because the locking steps 56 on the coupling projections 55 on the top of the piston are locked to and supported by the locking step 46 on the inner side of the shoulder.

A process of discharging makeup in the cosmetic container assembled in this way to use is described hereafter. When a user presses the pressing plate 63, the pressing plate is elastically pressed and compresses the spring 65.

As the pressing plate 63 is moved downward, the pressing bars 63*a* on the bottom of the pressing plate press the piston 50.

In this process, the locking steps 56 on the coupling projections 55 of the piston 50 are unlocked from the locking step 46 on the inner side of the shoulder, so the piston starts to move downward.

When the piston 50 is pressed by the pressing plate 63, the inner wing 51 is hermetically moved downward in elastically close contact with the outer side of the vertical tube 32 of the inner container 30 and the outer wing 52 is hermetically moved downward in elastically close contact with the inner side of the storage space 31 of the inner container 30.

As the piston 50 is pressed, the makeup in the inner container 30 is vertically moved upward through the hole 32*a* at the lower portion of the vertical tube 32 and the feeding hole 32*b* in the vertical tube 32 and fed to the valve hole 61 of the valve body 61.

Further, the makeup is discharged in all directions through the discharge holes 61*b* circumferentially arranged at the upper portion of the valve body 61.

The discharge holes 61*b* of the valve body 61 are closed by the packing inside the pressing plate 63, but when the pressing plate 63 is pressed, the packing 64 comes off the inclined surface 61*c* on the upper outer side of the valve body 61, so the discharge holes 61*b* are opened and the makeup is discharged.

The makeup discharged through the discharge hole 61*b* at the upper portion of the valve body 61 is guided onto the top of the pressing plate 63 and a user puts the makeup on the puff 70 to use it.

When the pressing plate 63 that has been pressed is released, the pressing plate 63 is returned upward by elasticity of the spring 65. In this process, the piston 50 is maintained in the position without moving up.

As the pressing plate 63 is returned upward, the packing 64 comes back in close contact with the inclined surface 61*c* on the upper outer side of the valve body 16 and closes the discharge holes 61*b*, thereby stopping discharge of the makeup.

Since the upper outer side of the pressing plate 63 is not in contact with, but is spaced 0.5~1 mm from the step 41 on the upper inner side of the shoulder 40, when the pressing plate 63 is moved as high as possible by the elasticity of the spring 65, the packing 64 is brought in elastically as close contact as possible with the inclined surface 61*c* on the upper outer side of the valve body 61, thereby securing high air-tightness.

In this process, the makeup remaining between the packing 64 and the inclined surface 61*c* on the upper outer side of the valve body 61 is discharged onto the top of the pressing plate 63 and used when the packing 64 comes in elastically close contact with the inclined surface 61*c* of the valve body 61, so the possibility of leakage of the makeup remaining after use is eliminated.

Further, since the recession 61*d* lower than the top of the pressing plate 63 is formed on the top of the valve body 61, even if the pressing plate 63 is not exactly pressed when a user presses the pressing plate 63 and the top of the valve body 61, the user's hand further moves downward by the recession 61*d*, so the pressing plate 63 can be surely pressed.

Accordingly, the present invention provides a simple structure of elastically pressing the pressing plate 63 with the spring 65 instead of an airless pump used in the related art, so it is possible to simply discharge and use the makeup in the inner container 30 by forcibly pressing the piston 50. Further, since the valve unit 60, shoulder 40, and piston 50 are combined in one assembly to be coupled to the upper portion of the inner container and then combined with the bottom body 20 and the inner container 30 filled with makeup, it is possible simplify assembly of the parts and to remove the problems in the related art, including poor filling due to a backfilling structure of makeup or difficulty in assembling parts.

Meanwhile, according to the present invention, as shown in FIGS. 11A to 14, a remaining pressure remover 80 for more smoothly removing remaining pressure due to the piston, for example, pressure remaining in the inner container without being discharged out through the air vent may be further disposed in the storage space 31 of the inner container 30.

The air vent 33 is provided to remove vacuum pressure in the inner container when the piston 50 is inserted into the inner container 30, but the lower end of the outer wing 52 is positioned lower than the bottom of the air vent when the piston is inserted into the inner container in order to apply a predetermined pressure to the makeup in the inner container.

Accordingly, when the piston 50 is combined, vacuum pressure in the inner container is removed when the lower end 52*a* of the outer edge 52 is positioned in the range of the air vent 33 on the inner side of the inner container 30, but when the lower end of the outer edge passes over the lower end of the air vent, a predetermined vacuum pressure is generated again in the inner container. Therefore, unless the vacuum pressure is removed, the makeup in the inner container may be unexpectedly discharged out while the piston is initially combined, so there is a need for means for solving this problem.

Accordingly, in consideration of the problem, the present invention further includes the remaining pressure remover 80 for removing pressure that is necessarily generated when the piston is inserted into the inner container 30. The remaining pressure remover 80 includes a support vertically supported in the inner container 30 and a cap 82 made of elastic rubber and having a first part integrally coupled to the support and a second part having pressure removable holes 82*a* for discharging internal pressure of the inner container 30 to the outside when the piston is combined. A coupling hole 83 that is fitted on the second end of the cap is formed through the piston and the pressure removable holes at the second part are closed by elastic contact with a covering portion 84 formed on the shoulder 40 at a corresponding position when the piston finishes being combined.

When the pressing plate 63 is pressed, the piston 30 with the coupling hole 83 fitted on the cap 82 of the remaining pressure remover 80 moves downward on the outer sides of the cap 82 and the support 81.

Since the remaining pressure remover 80 is further provided, as described above, even though the piston 50 is combined, with the inner container 30 filled with makeup, the internal pressure of the inner container is primarily removed by the air vent 33. Further, even though the lower end 52*a* of the outer wing 52 of the piston 50 is moved downward further than the lower end of the air vent, the pressure generated in this process is secondarily discharged to the outside through the pressure removable hole 82*a* formed in the cap 82 of the remaining pressure remover 80. Accordingly, the piston 50 can be correspondingly more quickly and easily be combined and it is possible to further prevent the makeup from being unexpectedly discharged to the outside while the piston is combined.

Therefore, according to the present invention, as the remaining pressure remover 80 is further provided, the piston can be more stably combined even though the inner container is filled with makeup and it is possible to prevent the makeup from being discharged to the outside, which may occur in this process, so assembly can be more stably achieved.

Although the present invention was described above with reference to the drawings, it should be understood that the present invention is not limited thereto and may be changed and modified without departing from claims.

The invention claimed is:

1. A push type cosmetic container comprising:

an inner container (30) inserted in a bottom body (20) of an outer container and having a vertical tube (32) formed at a center of a storage space (31) for keeping makeup to feed the makeup vertically upward;

a shoulder (40) fixed on the inner container;

a piston (50) inserted in the storage space (31) of the inner container (30) to be movable downward; and a valve unit (60) for discharging the makeup by opening a valve body (61) coupled to a top of the vertical tube (32) in the inner container when the piston (50) is pressed by pressing a pressing plate (63) supported over the inner container (30) by a spring (65), wherein the valve unit (60) includes: the valve body (61) fitted on the vertical tube (32) of the inner container (30) and having a valve hole (61*a*) and discharge holes (61*b*) circumferentially arranged at an upper portion; a pressing plate (63) disposed outside the upper portion of the valve body (61) and having pressing bars (63*a*) on a bottom for pressing the piston (50); and the spring (65) supporting the bottom of the pressing plate (63), wherein an inner side of the pressing plate (63) is in close contact with an inclined surface (61*c*) formed on an outer side of the upper portion of the valve body (61) to open and close the discharge holes (61*b*) of the valve body when the pressing plate (63) is pressed, and wherein cosmetic container coupling projections (55) each having a locking step (56) on an upper outer side are vertically formed on the piston (50) and, coupling holes (45) in which the coupling projections (55) are inserted are formed in the shoulder (40) and a locking step (46) locking the locking steps (56) of the coupling projections to prevent separation is formed on an inner side of the shoulder (40) so that an assembly of the valve unit (60), the shoulder (40), and the piston (50) is combined with the bottom body (20) of the outer container, and the locking steps (56) of the piston (50) and the locking step (46) of the shoulder (40) are rounded projections to release the pressing plate (63) when the pressing plate (63) is initially pressed.

2. The cosmetic container of claim 1, wherein a packing (64) being in close contact with the inclined surface (61*c*) on the outer side of the upper portion of the valve body (61) is disposed inside the pressure plate (63) for hermetic operation.

3. The cosmetic container of claim 1, wherein an upper outer side of the pressing plate (63) is spaced from a step (41) formed on an inner side of a upper portion of the shoulder (40) so that the pressing plate (63) is in close contact with the inclined surface (61*c*) on the outer side of the upper portion of the valve body (61) by elasticity of the spring (65).

4. The cosmetic container of claim 1, wherein air vents (33) are formed at one or more positions on an inner side of the storage space (31) of the inner container (30) from an upper end to an initial insertion position of the piston (50).

5. The cosmetic container of claim 1, wherein a recession (61*d*) that is lower than a top of the pressing plate (63) is formed on a top of the valve body (61).

6. The cosmetic container of claim 1, wherein the spring (65) supporting the pressing plate (63) has any one of a conical shape and an inverse conical shape.

7. The cosmetic container of claim 1, wherein the pressing bars (63*a*) on the bottom of the pressing plate (63) are spaced at a predetermined distance from a top of the piston (50).

8. The cosmetic assembly of claim 1, wherein the shoulder (40), the piston (50), and the valve unit (60) are combined in one assembly and then the assembly is combined with the bottom body (20) and the inner container (30) filled with makeup.

9. A push type cosmetic container comprising:

an inner container (30) inserted in a bottom body (20) of an outer container and having a vertical tube (32) formed at a center of a storage space (31) for keeping makeup to feed the makeup vertically upward;

a shoulder (40) fixed on the inner container;

a piston (50) inserted in the storage space (31) of the inner container (30) to be movable downward; and a valve unit (60) for discharging the makeup by opening a valve body (61) coupled to a top of the vertical tube (32) in the inner container when the piston (50) is pressed by pressing a pressing plate (63) supported over the inner container (30) by a spring (65), wherein the valve unit (60) includes: the valve body (61) fitted on the vertical tube (32) of the inner container (30) and having a valve hole (61*a*) and discharge holes (61*b*) circumferentially arranged at an upper portion; a pressing plate (63) disposed outside the upper portion of the valve body (61) and having pressing bars (63*a*) on a bottom for pressing the piston (50); and the spring (65) supporting the bottom of the pressing plate (63), wherein an inner side of the pressing plate (63) is in close contact with an inclined surface (61*c*) formed on an outer side of the upper portion of the valve body (61) to open and close the discharge holes (61*b*) of the valve body when the pressing plate (63) is pressed, and wherein a remaining pressure remover (80) for removing remaining pressure is provided in the storage space (31) of the inner container.

10. The cosmetic container of claim 9, wherein the remaining pressure remover (80) includes: a support (81) vertically supported in the inner container (30); and a cap (82) made of elastic rubber and having a first part integrally coupled to the support and a second part having pressure removable holes (82*a*) for discharging internal pressure of the inner container (30) to the outside when the piston is combined, and a coupling hole (83) fitted on the second end of the cap is formed through the piston and the pressure removable holes at the second part are closed by elastic contact with a covering portion (84) formed on the shoulder (40) at a corresponding position when the piston finishes being combined.

11. The cosmetic container of claim 9, wherein a packing (64) being in close contact with the inclined surface (61*c*) on the outer side of the upper portion of the valve body (61) is disposed inside the pressure plate (63) for hermetic operation.

12. The cosmetic container of claim 9, wherein an upper outer side of the pressing plate (63) is spaced from a step (41) formed on an inner side of a upper portion of the shoulder (40) so that the pressing plate (63) is in close contact with the inclined surface (61*c*) on the outer side of the upper portion of the valve body (61) by elasticity of the spring (65).

13. The cosmetic container of claim 9, wherein air vents (33) are formed at one or more positions on an inner side of the storage space (31) of the inner container (30) from an upper end to an initial insertion position of the piston (50).

14. The cosmetic container of claim 9, wherein a recession (61*d*) that is lower than a top of the pressing plate (63) is formed on a top of the valve body (61).

15. The cosmetic container of claim 9, wherein the spring (65) supporting the pressing plate (63) has any one of a conical shape and an inverse conical shape.

16. The cosmetic container of claim 9, wherein the pressing bars (63*a*) on the bottom of the pressing plate (63) are spaced at a predetermined distance from a top of the piston (50).

17. The cosmetic assembly of claim 9, wherein the shoulder (40), the piston (50), and the valve unit (60) are combined in one assembly and then the assembly is combined with the bottom body (20) and the inner container (30) filled with makeup.

* * * * *